US009429289B2

(12) United States Patent
Meyrenaud

(10) Patent No.: US 9,429,289 B2
(45) Date of Patent: Aug. 30, 2016

(54) LIGHTING AND/OR SIGNALING UNIT, NOTABLY FOR A MOTOR VEHICLE

(71) Applicant: Valeo Vision, Bobigny (FR)

(72) Inventor: Jean-Luc Meyrenaud, Livry Gargan (FR)

(73) Assignee: Valeo Vision, Bobigny (FR)

( * ) Notice: Subject to any disclaimer, the term of this patent is extended or adjusted under 35 U.S.C. 154(b) by 10 days.

(21) Appl. No.: 14/185,066

(22) Filed: Feb. 20, 2014

(65) Prior Publication Data

US 2014/0233254 A1 Aug. 21, 2014

(30) Foreign Application Priority Data

Feb. 21, 2013 (FR) ..... 13 51491

(51) Int. Cl.
*F21V 5/00* (2015.01)
*F21S 8/10* (2006.01)

(52) U.S. Cl.
CPC ..... *F21S 48/12* (2013.01); *F21S 48/1154* (2013.01); *F21S 48/1291* (2013.01); *F21S 48/1747* (2013.01); *F21S 48/215* (2013.01); *F21S 48/2212* (2013.01)

(58) Field of Classification Search
CPC ..... F21S 48/1154; F21S 48/1241; F21S 48/1163; F21S 48/1208; F21S 48/1291; F21S 48/1747; F21S 48/215; F21S 48/2206; F21S 48/2212; F21S 48/2243; F21S 48/2262; F21S 48/32; F21S 48/328; B60Q 1/0041; B60Q 1/20; F21K 9/00
USPC ..... 362/520, 311.08, 311.07, 311.09
See application file for complete search history.

(56) References Cited

U.S. PATENT DOCUMENTS

| | | | | |
|---|---|---|---|---|
| 5,499,262 | A * | 3/1996 | Nakata | 372/108 |
| 7,204,627 | B2 * | 4/2007 | Ishida | 362/509 |
| 7,625,102 | B2 | 12/2009 | Koike et al. | |
| 2006/0083002 | A1 | 4/2006 | Koike et al. | |
| 2006/0250810 | A1 * | 11/2006 | Casenave et al. | 362/538 |
| 2008/0253143 | A1 * | 10/2008 | Blandin et al. | 362/523 |
| 2009/0091944 | A1 * | 4/2009 | de Lamberterie | 362/516 |
| 2010/0084667 | A1 * | 4/2010 | Mcfadden et al. | 257/88 |
| 2013/0044503 | A1 * | 2/2013 | Mihara et al. | 362/511 |

FOREIGN PATENT DOCUMENTS

| | | |
|---|---|---|
| EP | 2525142 | 11/2012 |

* cited by examiner

*Primary Examiner* — Evan Dzierzynski
*Assistant Examiner* — Tsion Tumebo
(74) *Attorney, Agent, or Firm* — Jacox, Meckstroth & Jenkins

(57) ABSTRACT

A lighting and/or signaling unit comprising a pair of light sources both cooperating with an optical element in such a way as to form two output light beams, depending on the desired lighting function. The output diopter, notably formed by elliptical portions, is adapted to accommodate the generation of beams from two sources spaced apart. Applicable to the motor vehicle industry.

28 Claims, 4 Drawing Sheets

LIGHTING AND/OR SIGNALING UNIT, NOTABLY FOR A MOTOR VEHICLE

CROSS-REFERENCE TO RELATED APPLICATIONS

This application claims priority to French Application No. 1351491 filed Feb. 21, 2013.

BACKGROUND OF THE INVENTION

1. Field of the Invention

The present invention relates notably to a lighting and/or signaling unit. A preferred application relates to the motor vehicle industry for the production of lighting and/or signaling devices, notably vehicle headlights.

2. Description of the Related Art

In the motor vehicle domain, lighting modules or headlights are known, among which there are traditionally, mainly: low beams, or code lights, long-range main beams, or even fog beams. The document EP-A1-2525142 gives an example of an optical unit that can produce a lighting function and that comprises a light source of light-emitting diode type (hereinafter referred to by its acronym LED) and a lens of the planar input diopter/convex output diopter with elliptical profile type, the LED being placed at an object focus of the output diopter.

Implementing these lighting or signaling devices entails having a lens suited to each function and therefore a plurality of lenses, each specific, and through each of which an output beam can be emitted toward the area of space to be illuminated, in a preferred direction constituting the optical axis of the device and according to very often standardized lighting or signaling parameters.

SUMMARY OF THE INVENTION

The invention makes it possible to at least partly resolve the drawbacks of the current techniques.

One aspect of embodiments of the invention relates to a lighting and/or signaling unit, notably for a motor vehicle, comprising a first light source and an optical element comprising an input diopter and an output diopter, the optical element being configured to enable the emission of a first output light beam by the output diopter on reception of a first input light flux, generated by the first light source, by the input diopter, wherein it comprises a second light source, the optical element being configured to enable the emission of a second output light beam by the output diopter on reception of a second input light flux, generated by the second light source, by the input diopter, the output diopter comprising a first portion matched more particularly to the first light source and a second portion matched more particularly to the second light source.

Thus, the invention pools the input diopter and the output diopter for the use of a plurality of sources. This is made possible through the adaptation of the output diopter which characteristically comprises two portions, each more particularly suited to a light source. Specifically, one of the portions is designed in relation to one light source, whereas the other portion is designed in relation to the other light source. For example, the first portion can be a surface having a focus or a focal line passing through one of the light sources, and the second portion can be a surface having a focus or a focal line passing through the other of the light sources.

According to one embodiment, the first portion is elliptical and at a first focus thereof is located the first light source. According to one embodiment, the second portion is also elliptical and at a first focus thereof is located the second light source, the first foci of the first elliptical portion and of the second elliptical portion being distinct.

According to one embodiment, the first light source and the second light source form a pair of sources configured for their mean emission directions to be parallel and being spaced apart from one another in a direction at right angles to their mean emission directions.

According to a preferred embodiment, the first portion and the second portion are located, on either side, and advantageously symmetrically in relation to a base plane passing through the middle of a segment defined by the pair of sources and parallel to the mean emission directions, the first portion and the second portion being able, for example, to be elliptical as described previously.

Preferentially, the light source is formed by at least one photoemitter of a light-emitting diode and the second light source is formed by at least one other photoemitter of the light-emitting diode.

By this means, the sources are effectively formed and are on a single LED which can then fulfill two lighting and/or signaling functions.

Other options are given hereinbelow, all the options of the invention being able to be implemented independently or in association according to all possible combinations:

- the base plane is vertical;
- the base plane defines a first half-space in which are located the first light source and the first portion and a second half-space in which are located the second light source and the second portion, the first portion and the second portion being able, for example, to be elliptical as described previously;
- the intersections between the base plane and, respectively, the first elliptical portion and the second elliptical portion are two first ellipse portions;
- the intersections between a plane at right angles to the base plane and parallel to the mean emission directions and, respectively, the first elliptical portion and the second elliptical portion are two second ellipse portions;
- respectively, the first ellipse portion and the second ellipse portion of the first elliptical portion, and the first ellipse portion and the second ellipse portion of the second elliptical portion have profiles of homothetic forms;
- the output diopter comprises a cylindrical surface defined by a generatrix at right angles to the mean emission directions and by a guiding curve formed from the first elliptical portion and the second elliptical portion;
- the first light source is of amber color and the second light source is of white color;
- the first light source and the second light source are located on the input diopter;
- the output diopter comprises a first lateral part adjacent to the first portion in the direction at right angles to the mean emission directions, the first lateral part comprising a succession of at least one surface of a form corresponding to the form of the assembly formed by the second portion and the first portion, the first portion and the second portion being able, for example, to be elliptical as described previously;
- the output diopter comprises a second lateral part adjacent to the second portion in the direction at right angles to the mean emission directions, the second lateral part comprising a succession of at least one surface of a form corresponding to the form of the assembly formed by the first portion and the second portion, the first portion and the second portion being able, for example, to be elliptical as described previously;

Another aspect of advantageous embodiments of the invention relates to a lighting and/or signaling module, notably for a motor vehicle, comprising at least one unit, the optical element of the at least one unit being formed in a lens.

Optionally, the module comprises a plurality of units in which optical elements are all formed in the lens.

The invention also relates to a light device, notably for lighting and/or signaling, notably for a motor vehicle, comprising at least one module according to the invention. For example, this can be a device for lighting the interior of the vehicle passenger compartment.

According to one embodiment of the invention, the light device is a lighting and/or signaling device for a vehicle and comprises two modules.

In a preferred case, the modules are located at different height levels in a vertical plane.

Optionally, the mean emission directions in at least one module are different from the mean emission directions in at least one other module.

Advantageously in this device, at least one module is configured for its mean emission directions, in the base plane, to be angularly offset relative to the horizontal such that the direction of a ray, from the second light source and passing through the intersection, in the base plane, of the first elliptical portion and of the second elliptical portion is oriented on the horizontal.

The device as a whole can preferentially be incorporated in a motor vehicle front headlight block. It is thus a unitary block.

Another subject of the invention is a vehicle equipped with at least one device of the invention and/or at least one unit and/or one module as indicated above.

Other features, aims and advantages of the present invention will become apparent on reading the following detailed description, and in light of the appended drawings given as nonlimiting examples and in which:

BRIEF DESCRIPTION OF THE ACCOMPANYING DRAWINGS

FIG. 1 illustrates the profile of an exemplary lighting and/or signaling unit according to the prior art;

FIG. 2 schematically represents the geometrical construction of a lens according to the invention;

FIG. 3 schematically represents a plan view of an embodiment of the invention;

DETAILED DESCRIPTION OF THE PREFERRED EMBODIMENTS

Figure 1:
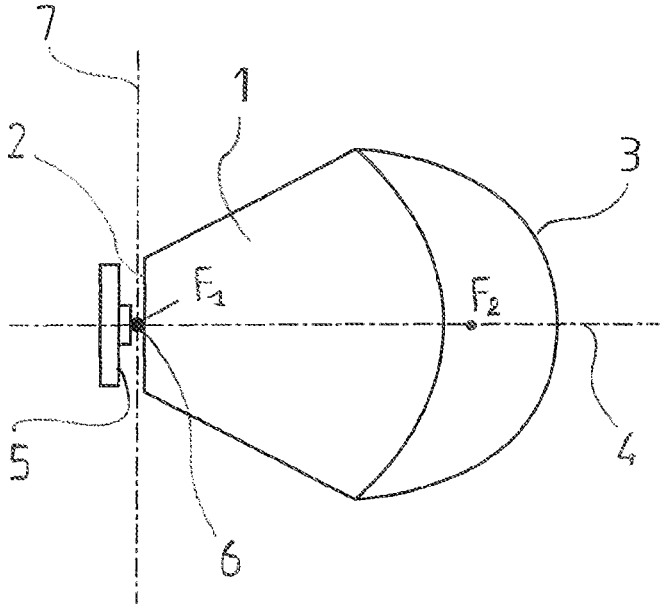
FIG.1 PRIOR ART

The terms "vertical" and "horizontal" are used in the present description to designate directions, notably beam directions, according to an orientation at right angles to the plane of the horizon for the term "vertical", and according to an orientation parallel to the plane of the horizon for the term "horizontal". They should be considered in the conditions of operation of the device in a vehicle. The use of these words does not mean that slight variations about the vertical and horizontal directions are excluded from the invention. For example, an inclination in relation to these directions of the order of + or −10° is considered here to be a minor variation about the two preferred directions.

The term "bottom" or bottom part should generally be understood to mean a part of an element of the invention located, on a vertical plane, below the optical axis. The term "top" or top part should be understood to mean a part of an element of the invention located, on a vertical plane, above the optical axis.

The term "parallel" or the concept of merged axes is understood here notably with the manufacturing or installation tolerances; directions that are substantially parallel or axes that are substantially merged fall within this context.

Furthermore, the relative positions of the different optical elements and of the noteworthy points, such as the light sources, the foci, the diopters and the lens, often expressed in this application for ease of understanding with terms of the type "in alignment" and/or "corresponding" and/or "located on" or "at" should not necessarily be interpreted exactly inasmuch as slight variations may be envisaged or even desirable in order, among other things, to correct the imperfect nature and certain optical aberrations of the optical elements, or to obtain certain additional effects.

The adjective elliptical is employed to define a surface which comprises, in at least one section plane, an ellipse portion profile. It may be an ellipsoidal surface, defined by the rotation of the ellipse portion on one of its axes. The case of FIG. 2 corresponds to this situation. It may also be a cylindrical surface, in particular of guiding curve formed by the ellipse portion and of generatrix at right angles to the ellipse portion. The case of FIG. 8 corresponds to this situation.

The case represented in the different figures is particularly suited to installation in a front headlight of a motor vehicle. Devices can moreover be installed in a vehicle so as to produce a front left part and a front right part of beam projection toward the front of the vehicle.

Generally, the present invention can use light sources of the light-emitting diode type, more commonly called LEDs. Notably, each of these LEDs can be provided with at least one photoemitter element such as a chip capable of emitting a light of intensity and color adjusted to the lighting and/or signaling function to be produced. For example, a first light source may comprise at least one photoemitter of an LED to provide lighting in amber light for a flashing direction change indication light. Moreover, a second light source may comprise at least one white light photoemitter of an LED to provide a daytime lighting function. One and the same LED can advantageously comprise at least two photoemitters, each configured to at least partly produce a lighting or signaling function differently.

The number of LEDs is not however limiting on the invention, nor on the number of functions likely to be implemented by the overall system of the invention. Moreover, the term light source should be understood here to mean a set of at least one individual source such as an LED chip capable of producing a flux resulting in the generation at the output of the device of the invention of an output flux fulfilling the desired function. Since the LEDs emit substantially in a half-space limited by their plane of installation, the mean emission direction of their photoemitters is typically at right angles to the plane of the LED.

All types of beams can be formed by virtue of the invention, including the different lighting and/or signaling functions indicated at the start of this description. Nevertheless, advantageously, the invention makes it possible to produce, with one and the same lens, all or part of a function of the direction change indication type or all or part of a daytime lighting type function.

FIG. 1 shows a lighting module according to the prior art in which a light source 6 can be seen and, in the example, consisting of a photoemitter element of an LED, located on a plane of LEDs 5. The light source 6 cooperates with a lens 1 of the planar convex thick lens type comprising in particular an input diopter 2 on a face situated facing the light source 6 and an output diopter 3. It will be understood that the rays generated by the light source 6 enter into the lens 1 through the input diopter 2 and are propagated toward the output diopter 3 through which the propagated rays are projected into the zone of the space to be illuminated. The output diopter 3 of convex type is notably in the form of an ellipsoidal portion and its intersection, relative to a vertical plane passing through the light source 6, consists, for example, of an ellipse portion at one of the foci of which is located the source 6. The device as a whole is oriented on an optical axis 4 according to which the mean emission direction of the lens 1 is directed. Namely, here, the right angle to the LED plane 5. As a general rule, the device represented in FIG. 1 is suitable for a vertical installation according to the profile illustrated. The direction 7 represented is then directed vertically. However, other installations are possible.

It will be understood that the device shown in FIG. 1 gives overall satisfaction for the production of a lighting function. However, this is found to be limiting and it can clearly be seen that the lens 1 has a bulk which is detrimental when the number of lighting and/or signaling functions is to be multiplied.

Figure 2:
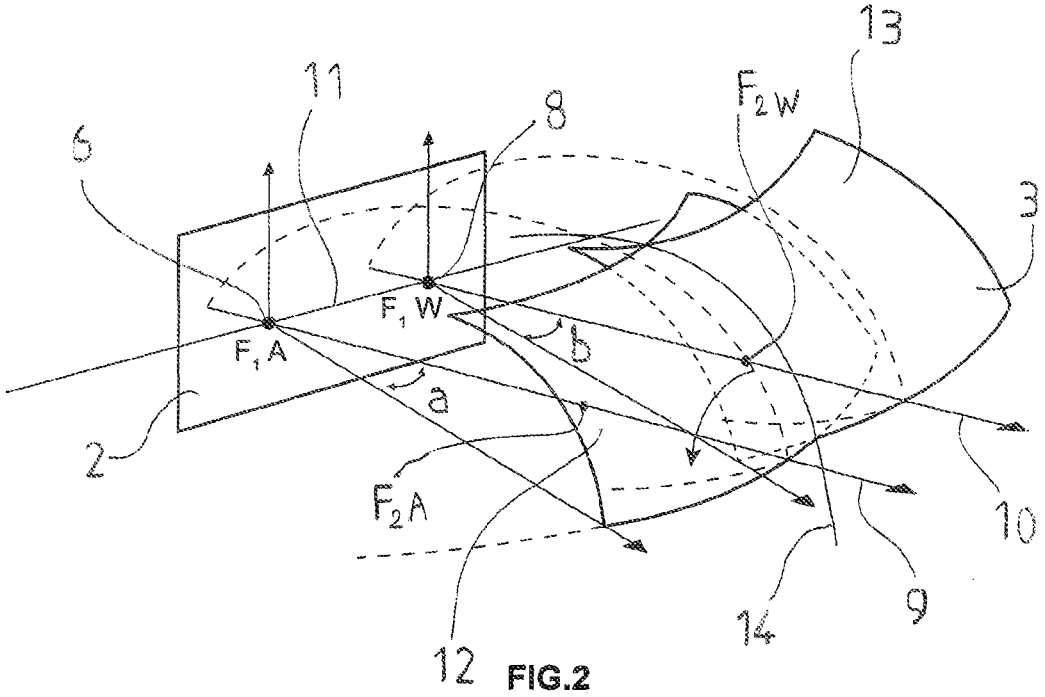

This difficulty is overcome according to one aspect of the invention, and notably by the unit whose geometrical construction is illustrated in FIG. 2. In this FIG. 2, there is shown, in addition to the light source 6, a second light source 8. The sources 6, 8 form a pair spaced apart such that a segment 11 is formed between them. Advantageously, the segment 11 is directed on a horizontal plane as is the case of FIG. 2 or in a vertical direction not illustrated.

The two sources 6, 8 are, moreover, advantageously situated on the input diopter 2, here schematically represented by the rectangular box illustrating the input face of a lens.

Figure 8:
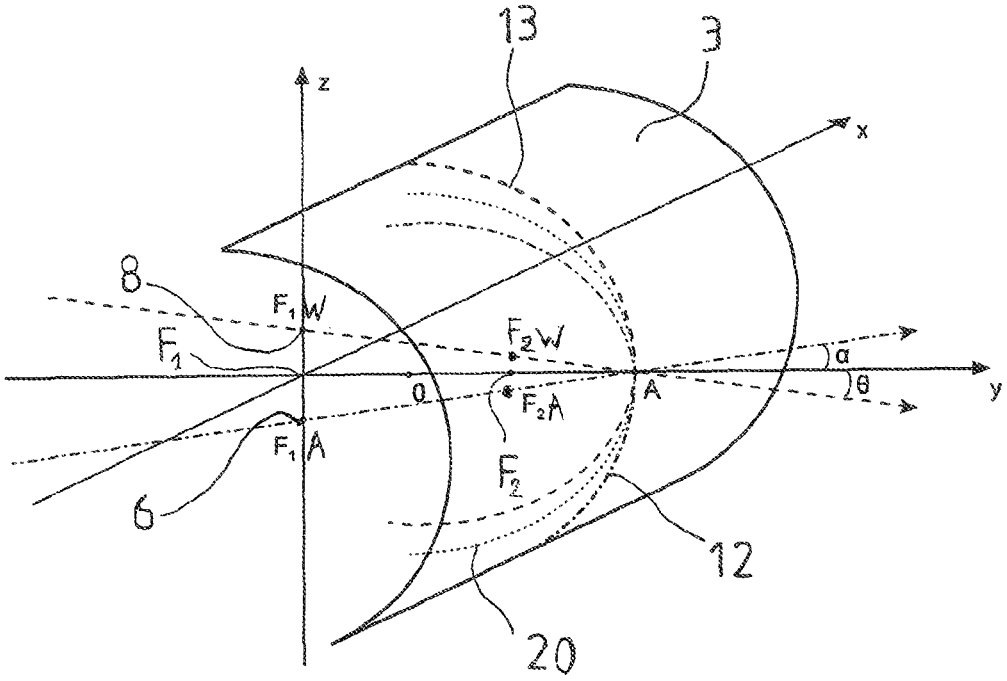
FIG. 8 illustrates another embodiment of the invention, with another form of output diopter, notably well suited to an alignment of the two light sources in a vertical direction.

Each of the sources 6, 8 is suitable for emitting an input light flux with mean direction corresponding respectively to the directions represented by the references 9 and 10. In the case illustrated, the directions 9, 10 are parallel and extend, in the example, in a horizontal plane. It will be recalled that the invention can be applied to other inclinations and, notably, the directions 9, 10 can be present in a vertical plane, in which case the embodiment described here and illustrated in FIG. 2 is to be transposed by 90° rotation about the straight line passing through the middle of the segment 11 and parallel to the directions 9, 10 constituting the optical axis of the unit as a whole. Another variant of the invention is illustrated in FIG. 8 in which the alignment of the sources 6, 8 is vertical.

According to one embodiment, one of the sources, for example the source 6, makes it possible to form a direction change indication function. Thus, there is represented, instead of the light source 6 in FIG. 2, the indication "A" meaning that it is a source of amber color. In the example represented, the second light source 8 produces a daytime lighting function which corresponds to the initial "W", corresponding to an emission of white color. As previously indicated, the light sources 6, 8 can be produced from technologies based on light-emitting diodes. Even more advantageously, the sources 6, 8 are made up of photoemitter elements produced in one and the same light-emitting diode. In the simplest example, a diode comprises two photoemitters, one amber, the other white, so as to respectively form the light source 6 and the light source

8. All of the power supply, control and installation means for the sources 6, 8 can thus be pooled within one and the same LED.

Because of the presence of two light sources 6, 8 spaced apart in the direction of the segment 11, the present invention offers the feature of having an optical element suited to the presence of these two sources 6, 8 so as to work, with a single optical element, in good conditions of propagation of the beams and of projection of the output beams despite the offset of the two sources 6, 8.

To this end, the optical element allowing for the input of the light beams from the two sources 6, 8 and the projection of the output beams can have the configuration illustrated in FIG. 2. The optical element according to the invention is understood to be a member suitable for producing the function of admission, of propagation and of projection of a beam from the light rays generated by one or other of the two sources 6, 8. In particular, the optical element can be produced in the form of all or part of a lens 1.

It should be noted that the invention is not limited to one choice of materials for forming the lens 1. It can be of polymers such as: polycarbonate, polymethyl methacrylate, polypropylene, polybutylene terephthalate or other polymers of the thermosetting type.

According to the invention, the optical element corresponding to the effective lens portion is split for the lighting function from the sources 6, 8 into two portions, each particularly matched to one of the two sources 6, 8.

Thus, a first elliptical portion 12 is constructed corresponding to a surface present on the output diopter 3 and comprising at least one elliptical profile in a plane of intersection with the elliptical portion 12. More particularly, the elliptical portion 12 accepts as focus F1A, the point in FIG. 2 which corresponds also to the place of installation of the light source 6. Advantageously, the intersection between the elliptical portion 12 and a vertical plane is an ellipse portion. Additionally or alternatively, it is advantageous that the intersection between a horizontal plane and the elliptical portion 12 is also formed by an ellipse portion. Preferably, the elliptical portion 12 extends angularly on either side of the mean emission direction 9 according to an angle "a". Clearance of the elliptical portion 12 in the horizontal plane represented in FIG. 2 about the direction 9 thus forms an angle of 2*a*. The elliptical portion 12 extends advantageously in the horizontal plane to a joint line 14 at which it meets a second elliptical portion 13.

The latter corresponds to a part of the surface of the output diopter 3 particularly suited to the lighting function corresponding to the second light source 8. The construction of the second elliptical portion 13 is preferentially substantially similar to that previously described for the elliptical portion 12. Thus, the second elliptical portion 13 advantageously has a section in the form of an ellipse portion on a vertical plane and/or on a horizontal plane. Moreover, it advantageously allows, as one of its foci F1W, the point where the second light source 8 is situated. Similarly, with respect to the mean emission direction 10 of the second light source 8, the second elliptical portion 13 exhibits an angular clearance in a horizontal plane corresponding to two times the angle schematically represented as "b" in FIG. 2. The angle "b" corresponds to the angular clearance between the mean emission direction 10 and the intersection between the horizontal plane and the joint line 14. It will be noted that the general optical axis of the duly constituted whole corresponds essentially to a straight line passing through the middle of the segment 11 and through the point of intersection between the joint line 14 and the horizontal plane containing the sources 6, 8. In the advantageous case represented in FIG. 2, a vertical plane passing through the duly defined optical axis cuts the output diopter 3 so as to form two half-spaces each comprising one of the elliptical portion 12 and the second elliptical portion 13. The whole is advantageously substantially symmetrical about this vertical plane.

As indicated previously and can be seen in FIG. 2, the profile of the ellipse portions 12, 13 is advantageously in the form of an ellipse section in a vertical cutting plane. It is also advantageously the case in a horizontal cutting plane. Furthermore, the elliptical profile in a horizontal plane can be obtained by geometrical construction from the profile in the vertical plane. FIG. 2 represents, by a curved arrow, the possibility of construction of the elliptical profile in the horizontal plane from that in the vertical plane. More particularly, once the elliptical profile is defined in the vertical plane notably by virtue of the definition of the foci, a 90° rotation is performed so as to transpose the elliptical profile considered into a horizontal plane. Dotted lines illustrate this 90° rotation. Then a scaling ratio can be applied between the two elliptical profiles situated in the vertical plane and in the horizontal plane so as to adapt the curvature of the elliptical profile in the horizontal plane of intersection of the elliptical portion 12 or 13. The scaling ratio is not limited according to the invention and will be adapted to the lighting beam to be formed. It will be recalled that the above description given in relation to FIG. 2 for the positioning of the two sources 6, 8 in a horizontal plane can be transposed for the formation of two directed sources 6, 8 for which the segment 11 has a vertical direction. Any other direction can moreover be envisaged by simple rotation.

It will be noted that, in the construction represented in FIG. 2, the elliptical portions 12, 13 advantageously each comprise a second focus, respectively F2A and F2B. These second foci are preferentially situated on the horizontal plane comprising the sources 6, 8 and advantageously respectively on the mean emission directions 9, 10.

Figure 3:
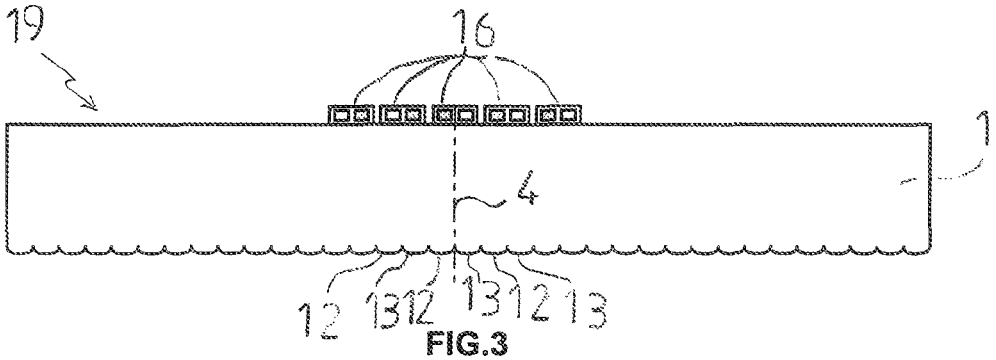

The unit according to the invention can thus be formed by the optical element defined as previously and by the pair of sources 6, 8. FIG. 3 gives a possible application thereof in plan view for an emission on an optical axis 4 advantageously horizontally. In this figure, there is an association of a plurality of LEDs 16, each comprising a source 6 and a second source 8. A slightly gray appearance of one of the sources in each of the LEDs 16 schematically represents the presence of a photoemitter of a color different from white, for example of an amber color. Thus, in the case of FIG. 3, a module 19 brings together a plurality of units as previously described, the units being juxtaposed in a direction advantageously corresponding to the direction of the segment 11 previously described with reference to the unit presented in FIG. 2. The direction of alignment in fact corresponds to a direction at right angles to the optical axis 4. In the non-limiting manner represented, the module 19 comprises a lens 1 common to all the units so that the optical elements of each unit are formed in the lens 1 which all the more pools the means. Because of the juxtaposition of the LEDs 16, there follows, on the output face of the lens 1, a juxtaposition of the elliptical portions 12, 13 of each unit. The lens 1 can have a width (in a direction corresponding to that of the segment 11) equivalent to that of the sum of the widths of the elliptical portions 12, 13.

In the case represented however, the lens 1 has an additional width on either side of the system of units formed. The benefit of this lateral extension will be explained in more detail with reference to another embodiment which can be seen in FIG. 6. It will be noted that it is not necessary to produce a strict alternation of light sources 6 and of second light sources 8. In the case of FIG. 3, starting from the left hand part of the figure toward the right hand part, the sources 6, 8 are respectively alternated as follows: white, amber, white, amber, amber, white, amber, white, amber, white. The elliptical portions 12, 13 are arranged in sequence on the front face in a corresponding manner. The inversion of certain sources 6, 8 directed according to the segment 11 makes it possible to distribute the output beams more effectively in the space.

It is in fact advantageous to be able to exploit the presence of a plurality of pairs of sources to apply a projection scanning that best matches the objectives set by the targeted lighting and/or signaling function.

Figure 4:
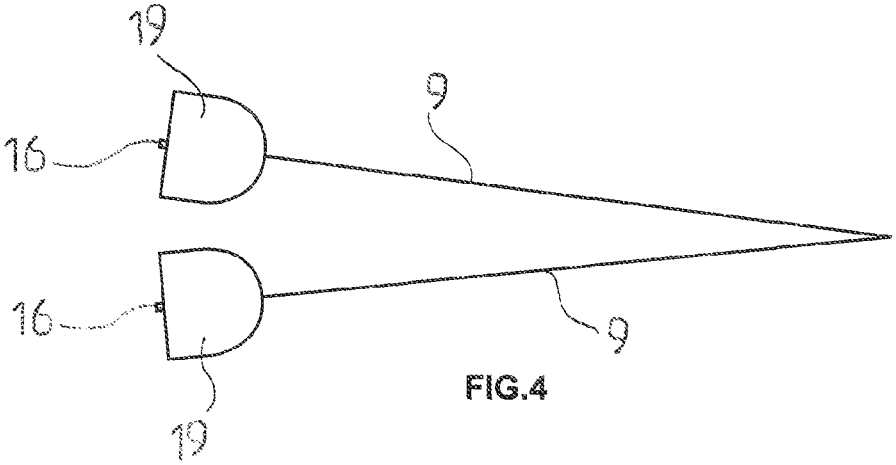
FIG. 4 illustrates, in profile on a vertical plane containing the optical axis, a device according to the invention.

In the case of FIG. 4, an example is produced for this purpose in the form of a device which in this case associates two modules 19 in a superposed manner (or juxtaposed if observing on a horizontal plane). In this example, the mean emission directions 9 or even the optical axes 4 of the modules 19 are different so as to produce a projection by a different angular clearance that makes it possible to best cover the portion of the space to be lit or signaled. It is thus possible, for example, to compensate the angular offset represented by the angles a, b in FIG. 2. The offset illustrated is purely indicative both in amplitude and in direction.

It will be noted that FIG. 4 schematically represents a single LED 16 per module 19 but each module 19 can comprise a plurality of LEDs 16 sequenced as, for example, in the case of FIG. 3. Furthermore, additionally or alternatively, the device can comprise a plurality of modules 19 presenting the units offset in a vertical plane or in a horizontal plane. For example, two modules 19 of the type illustrated in FIG. 3 can be superposed by laterally offsetting their axes 4.

Figure 5:
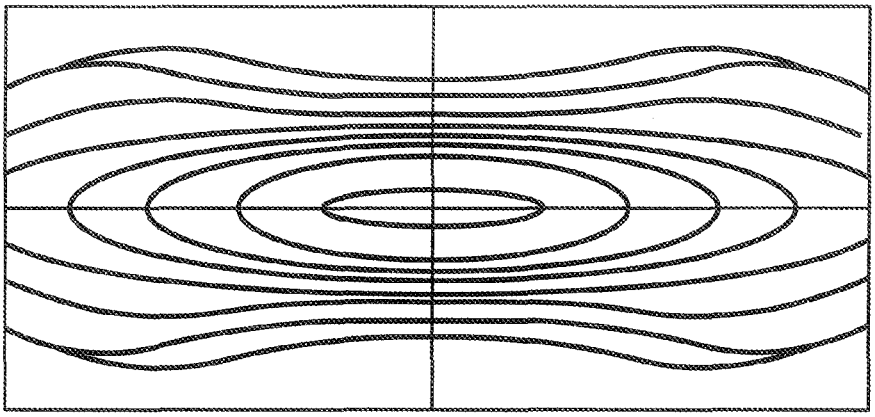
FIG. 5 is an isolux diagram of a light beam produced by a lighting device according to FIG. 4.

FIG. 5 illustrates an example of isolux curves obtained with a device corresponding to that of FIG. 4 for a daytime lighting function, the direction change indication function being substantially similar.

Figure 6:
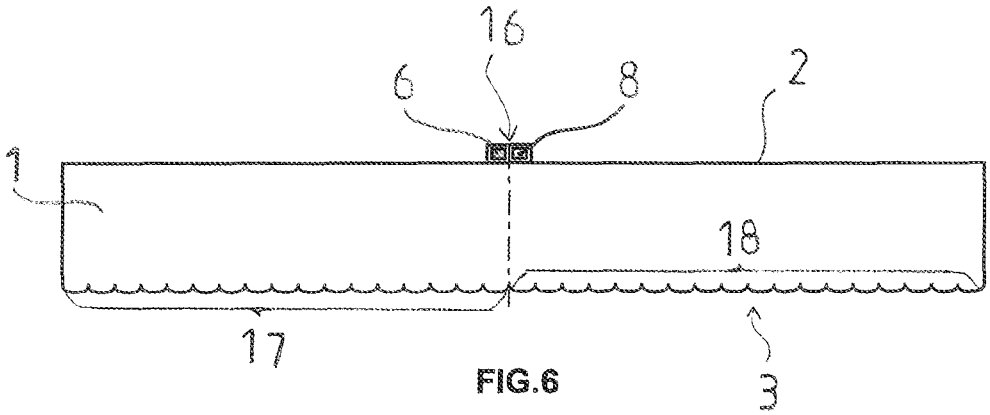
FIG. 6 shows a plan view of another embodiment of the invention.

FIG. 6 shows another embodiment of the invention in which a unit, as described previously, comprises a pair of sources 6, 8 advantageously formed in an LED 16 on an input diopter 2. Nevertheless, the output face corresponding to the output diopter 3 of the optical element of this unit here advantageously comprises two lateral parts 17, 18 on either side of the elliptical portions 12, 13. It will be understood that the output diopter 3 is substantially extended according to this possibility within one and the same unit. It is not absolutely necessary for this unit to have both the two extension portions 17 and 18. One unit may comprise just a single extension 17 or 18. By combining the teaching of FIG. 6 with that of FIG. 3, it will be understood that, in the case of FIG. 3, the unit positioned leftmost in the figure comprises a lateral part 17 whereas the unit positioned rightmost in FIG. 3 comprises a lateral part 18.

Figure 7:
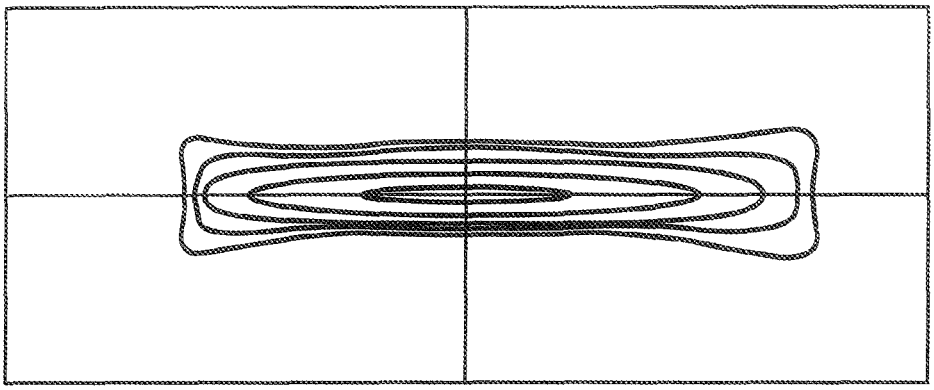
FIG. 7 is an isolux diagram of a light beam produced by a device of the invention in the embodiment of FIG. 6.

It is also possible to associate units such as those which can be seen in FIG. 6 in a sequenced manner in a direction corresponding to that of the segment 11. In this case, the pairs of sources 6, 8 are spaced apart by a width substantially equivalent to that of the lateral parts 17, 18. The configuration of FIG. 6 surprisingly produces a projection of beams which can be suitable for certain functions and notably the daytime lighting and direction change functions. FIG. 7 shows an example of beam spreading in isolux curves corresponding to this case in point. Although more gathered together than the spread in FIG. 5, an advantageous result is obtained given the presence of a single pair of sources in this case in point.

FIG. 8 shows an embodiment of the invention which is particularly, but in a nonlimiting manner, suited to sources 6, 8 aligned in a vertical direction. In the case represented, the two sources 6, 8 are spaced apart vertically along the axis referenced "z ". The lines shown as dotted lines in FIG. 8 show an example of construction of the profile of the output diopter in a plane, here vertical, corresponding to the plane "yz" passing through the point F1. In relation to the case of FIG. 1, the point F1 represents the place of a first focus of an ellipsoid profile 20 of a conventional lens shown by short and thin dotted lines. The point O is the center of the ellipse and F2 its second focus. The point A corresponds to the point of the output diopter 3 situated on the optical axis. Starting from this configuration, the profile of the output diopter 3 of the invention comprises two ellipsoid sections each participating in one of the portions 12, 13.

In the bottom part, under the horizontal plane "xy" passing through F1, the profile of the portion 12 is a part of ellipse defined by a first focus F1 A where the first source 6 is situated and by a second focus F2A situated under the point F2 and on an ellipse axis offset by an angle "60" relative to the direction of the axis y and advantageously passing through the point A.

In the top part, above the horizontal plane "xy" passing through F1, the profile of the portion 13 is a part of ellipse defined by a first focus F1W where the second source 8 is situated and by a second focus F2W situated under the point F2 and on an ellipse axis offset by an angle "74" relative to the direction of the axis y and advantageously passing through the point A.

There is thus obtained a complex section in the plane "xz" with two parts of ellipses, these ellipses being respectively defined by their foci F1A, F2A and FlW and F2W. The two parts of ellipses advantageously meet at the point A.

On the basis of this complex section, the three-dimensional form of the output diopter 3 can be produced by the generation of a cylindrical surface with a generatrix preferentially parallel to the axis "x" and adopting the complex section as the main curve. The result is a cylindrical ply of vertical section with two pieces of ellipses, so that the output diopter 3 comprises two elliptical portions 12, 13, each particularly matched to one of the sources 6,8.

In the case of superposition of modules of the invention each incorporating at least one unit formed according to the embodiment of FIG. 8, it is advantageous to alternate the types of sources 6, 8. For example, in a first module, a source of a first color is situated at the bottom and a source of a second color is situated above it. In another superposed module, a source of the first color is situated above and a source of the second color is situated below. This makes it possible to better distribute the beams of a given color in a sector of the space to be covered, to take account of the angular offsets of projection induced by the angles "α" and "θ".

This configuration could be employed, with simple corresponding angular modifications, for sources aligned horizontally or in other directions.

Finally, by making relatively little modification to the profile of the output diopter which remains of the type with elliptical section, the optical element can be exploited for dual use from two different light sources 6, 8.

The invention is not limited to the embodiments described previously but extends to all embodiments that conform to its spirit.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lighting and/or signaling unit, notably for a motor vehicle, comprising a first light source and an optical element comprising an input diopter and an output diopter, said optical element being configured to enable an emission of a first output light beam by said output diopter on reception of a first input light flux, generated by said first light source, by said input diopter, said optical element being configured to enable an emission of a second output light beam by said output diopter on reception of a second input light flux, generated by a second light source, by said input diopter, said output diopter comprising a first portion matched more particularly to said first light source and a second portion matched more particularly to said second light source;

wherein said first light source has a first mean emission direction and said second light source has a second mean emission direction, said first and second mean emission directions being generally parallel to an optical axis of said optical element and being spaced apart from one another in a direction at generally right angles to their respective first or second mean emission directions;

wherein said first mean emission direction of said first light source goes through said first portion of said output diopter and said second mean emission direction of said second light source goes through said second portion of the output diopter;

said first portion and second portion being generally elliptical and having a first focus and a second focus, respectively, said first and second light sources being generally situated at said first and second focuses, respectively;

wherein said optical diopter is substantially symmetrical about an intersection between said first portion and said second portion.

2. The lighting and/or signaling unit according to claim 1, in which said first portion is elliptical and at a center of a first focus thereof is located said first light source.

3. The lighting and/or signaling unit according to claim 2, in which said second portion is elliptical and at a center of a first focus thereof is located said second light source, said first foci of said first portion and of said second portion being distinct.

4. The lighting and/or signaling unit according to claim 1, in which said first portion and said second portion are located on either side of a base plane passing through a middle of a segment defined by said first and second light sources and parallel to the mean emission directions.

5. The lighting and/or signaling unit according to claim 4, in which said base plane is vertical or horizontal.

6. The lighting and/or signaling unit according to claim 1, in which a base plane defines a first half-space in which are located said first light source and said first portion and a second half-space in which are located said second light source and said second portion.

7. The lighting and/or signaling unit according to claim 4, in which the intersections between said base plane and, respectively, said first portion and said second portion are two first ellipse portions.

8. The lighting and/or signaling unit according to claim 4, in which the intersections between a plane at right angles to said base plane and parallel to the mean emission directions and, respectively, said first portion and said second portion are two second ellipse portions.

9. The lighting and/or signaling unit according to claim 7, in which, respectively, said first ellipse portions and said second ellipse portions of said first portion, and said first ellipse portions and said second ellipse portions of said second portion have profiles of homothetic forms.

10. The lighting and/or signaling unit according to claim 7, in which said output diopter comprises a cylindrical surface defined by a generatrix at right angles to the mean emission directions and by a guiding curve formed from said first portion and said second portion.

11. The lighting and/or signaling unit according to claim 1, wherein said first light source is formed by at least one photoemitter of a light-emitting diode and in which said second light source is formed by at least one other photoemitter of the light-emitting diode.

12. The lighting and/or signaling unit according to claim 1, wherein said first light source is of amber color and said second light source is of white color.

13. The lighting and/or signaling unit according to claim 1, wherein said first light source and said second light source are located on said input diopter.

14. The lighting and/or signaling unit according to claim 1, wherein said output diopter comprises a first lateral part adjacent to said first portion in a direction at right angles to a mean emission directions, said first lateral part comprising a succession of at least one surface of a form corresponding to a form of an assembly formed by said second portion and said first portion.

15. The lighting and/or signaling unit according to claim 1, wherein said output diopter comprises a second lateral part adjacent to said second portion in a direction at right angles to a mean emission directions, said second lateral part comprising a succession of at least one surface of a form corresponding to a form of an assembly formed by said first portion and said second portion.

16. A lighting and/or signaling module, notably for a motor vehicle, comprising at least one unit according to claim 1, wherein said optical element of the at least one unit being formed in a lens.

17. The lighting and/or signaling module according to claim 16, comprising a plurality of units in which said optical elements are all formed in said lens.

18. The lighting and/or signaling module according to claim 17, in which said plurality of units are aligned in the direction at right angles to mean emission directions.

19. A light device, notably for lighting and/or signaling, notably for a motor vehicle, comprising at least one module according to claim 17.

20. A lighting and/or signaling device, notably for a motor vehicle, comprising at least two modules according to claim 16.

21. The lighting and/or signaling device according to claim 20, in which said at least two modules are located at different height levels in a vertical plane.

22. The lighting and/or signaling device according to claim 20, in which the mean emission directions in at least one module are different from the mean emission directions in at least one other module.

23. The lighting and/or signaling device according to claim 22, in which at least one module is configured for its mean emission directions, in a base plane, to be angularly offset relative to the horizontal such that the direction of a ray, from said first light source and passing through the intersection, in said base plane, of said first portion and of said second portion is oriented on the horizontal.

24. The lighting and/or signaling device according to claim 23, in which at least one module is configured for its mean emission directions, in a base plane, to be angularly offset relative to the horizontal such that the direction of a ray, from said second light source and passing through the intersection, in said base plane, of said first portion and of said second portion is oriented on the horizontal.

25. The lighting and/or signaling unit according to claim 4, in which said base plane defines a first half-space in which are located said first light source and said first portion and a second half-space in which are located said second light source and said second portion.

26. The lighting and/or signaling unit according to claim 5, in which the intersections between said base plane and, respectively, said first portion and said second portion are two first ellipse portions.

27. The lighting and/or signaling unit according to claim 5, in which the intersections between a plane at right angles to said base plane and parallel to the mean emission directions and, respectively, said first portion and said elliptical portion are two second ellipse portions.

28. The lighting and/or signaling device according to claim 21, in which the mean emission directions in at least one module are different from the mean emission directions in at least one other module.

* * * * *